US005586822A

United States Patent [19]

Krzywdziak

[11] Patent Number: 5,586,822

[45] Date of Patent: Dec. 24, 1996

[54] STIRRER LID FOR COLOR CANS OF STIRRING MACHINES

[75] Inventor: Alain Krzywdziak, Orleans, France

[73] Assignee: F.A.S., Orleans Cedex, France

[21] Appl. No.: 498,198

[22] Filed: Jul. 5, 1995

[30] Foreign Application Priority Data

Jul. 5, 1994 [FR] France ..... 94 08283

[51] Int. Cl.[6] ..... B01F 7/20

[52] U.S. Cl. ..... 366/247; 366/605

[58] Field of Search ..... 366/605, 348, 366/349, 347, 241, 244, 245, 247, 249, 250

[56] References Cited

U.S. PATENT DOCUMENTS 3,175,808 3/1965 Dedoes ..... 366/605

4,926,390 5/1990 Murzsa ..... 366/605

5,456,534 10/1995 Krzywdziak ..... 366/605

*Primary Examiner*—Robert W. Jenkins

*Attorney, Agent, or Firm*—Scully, Scott, Murphy & Presser

[57] ABSTRACT

The invention relates to a stirrer lid for color cans of stirring machines.

This stirrer lid, of the type including a sealing element having a shutter (13) or having a pull flap closing the pouring lip (7), operated into the open position for pouring the color by a respective opposed operating lever (15) mounted on the body part of the lid, is characterized in that it includes at least one helical spring (25) for returning the said sealing element of the lip into the closed position, arranged laterally relative to the lip and oriented downward, toward the outside of the lid, this spring being connected by its ends to a fixing element (27) on the sealing element, a lug or fastener, and likewise to the lower part of the lip. FIG. 1.

8 Claims, 4 Drawing Sheets

STIRRER LID FOR COLOR CANS OF STIRRING MACHINES

Figure 1:
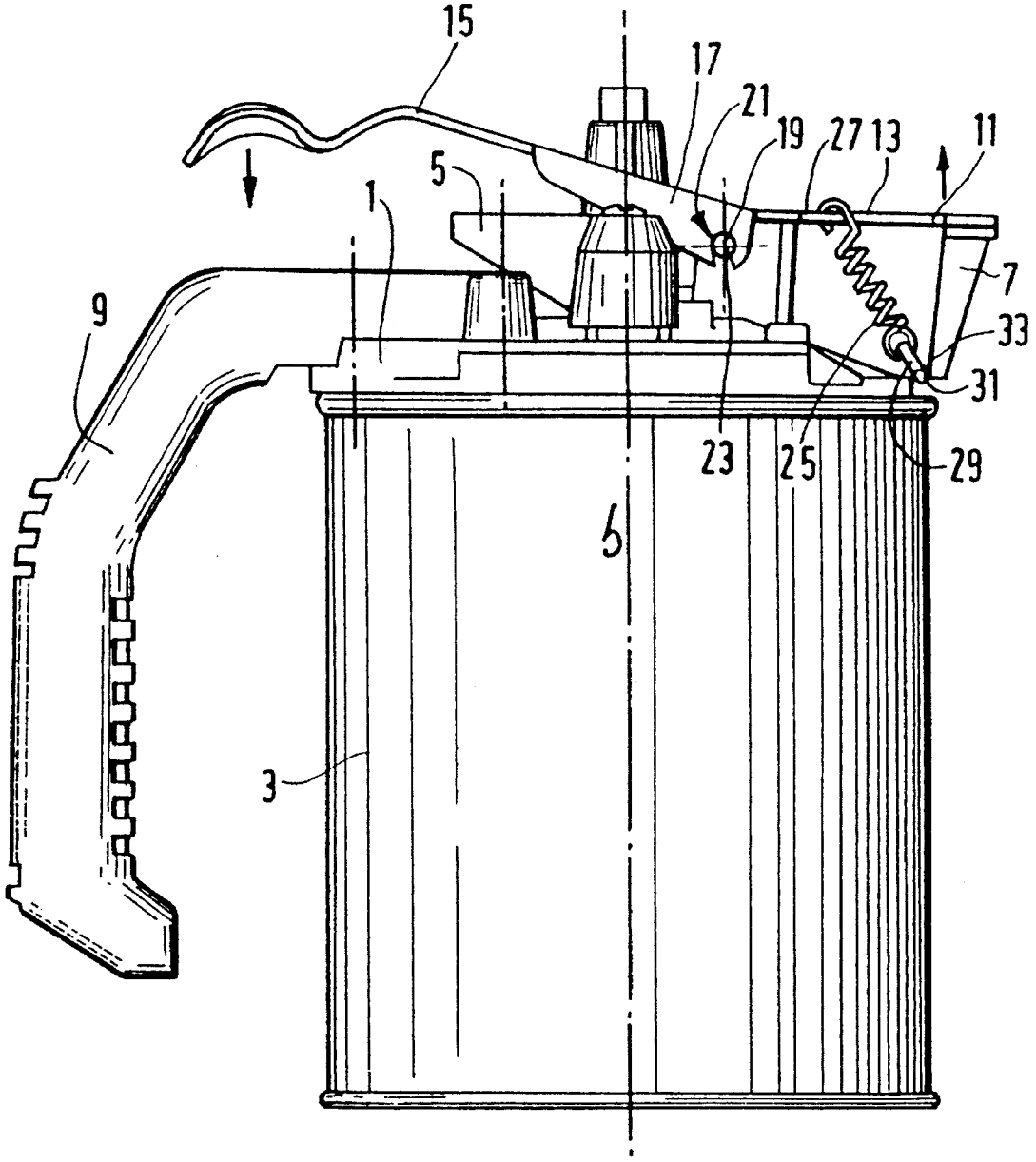

The invention relates to a stirrer lid for color cans of stirring machines and, in particular, a stirrer lid having an improved sealing system, fitted with a shutter or pull flap closing the pouring lip actuated into the open position by an operating lever.

These stirrer lids are well known. In particular, a stirrer lid for color cans to be arranged on a stirring machine and whose pouring lip projecting from the annular body part is closed by a shutter mounted so as to pivot on the rear part of the lip, this shutter being operated by angular movement at the front part of the lip by an opposed operating lever mounted on the body part of the lid, is known. The shutter is mounted on a pin transverse to the profile of the lip. This pin is mounted, attached by riveting or welding, on the upper drum of the body of the lid. The shutter is returned into the closed position on the lip by means of spiral springs mounted on the pin of the shutter. This type of lid has drawbacks in terms of manufacturing, in particular as regards the additional mounting of the pivot pin of the shutter (riveted pin). Moreover, the springs impose a constraint on the shaping of the lip and, as a result on the play in the pivoting of the shutter on its pin with wear, they tend to push the shutter upward, creating a clearance of the rear part of the shutter on the corresponding opening part of the lip to the detriment of the sealing of the closure.

The invention aims to remedy these drawbacks and provides a stirrer lid for color cans to be arranged on stirring machines, of the type including a sealing element having a pull flap or shutter closing the pouring lip, operated into the open position for pouring the color by an opposed operating lever mounted on the body part of the lid, characterized in that it includes at least one helical spring for returning the said sealing element of the lip into the closed position, arranged laterally relative to the lip and oriented downward, toward the outside of the lid, this spring being connected by its ends to a fixing element on the sealing element, a lug or fastener, and likewise to the lower part of the lip.

The lid according to the invention advantageously includes two identical helical springs for returning the sealing element into the closed position, these springs being arranged symmetrically relative to a vertical mid-plane of the lid, each connected by its top end to the sealing element and by its bottom end to the front base of the lip. These springs may be parallel, each lying in a vertical plane at an equal distance from the vertical mid-plane of the lid.

As a result of this arrangement of the springs for returning the sealing element of the lip into the closed position, essentially at the front part of the pouring lip, it constitutes an optimum position for exerting closure return forces as close as possible to the opening in the lip and in the orientation most favorable for maximum contact between the opening in the lip and the corresponding sealing element.

Moreover, this arrangement of the springs toward the front frees the rear part of the lip from the constraints regarding shape (profiling) that exist in conventional shapes of sprung lid toward the rear and thus make it possible, for example, during manufacture, to mold the pin of the shutter simultaneously with the body part of the lid. This avoids the traditional additional mounting of the pins and consequently simplifies the manufacture of the lid.

Furthermore, the shutter advantageously includes two side flanges for joining to the operating lever, forming a supporting element for pivoting of the latter on the said pin of the lid, these lugs including a truncated opening for insertion into [sic] the pin formed in a complementary fashion, allowing it to be instantly mounted in the inclined position and locked in the closed position.

The springs may also be connected by their lower end to a single rod engaged and retained in a groove in the front base of the lid, free to orient in the angular exercise of the springs on its fixing points (lugs or folds).

Figure 2:
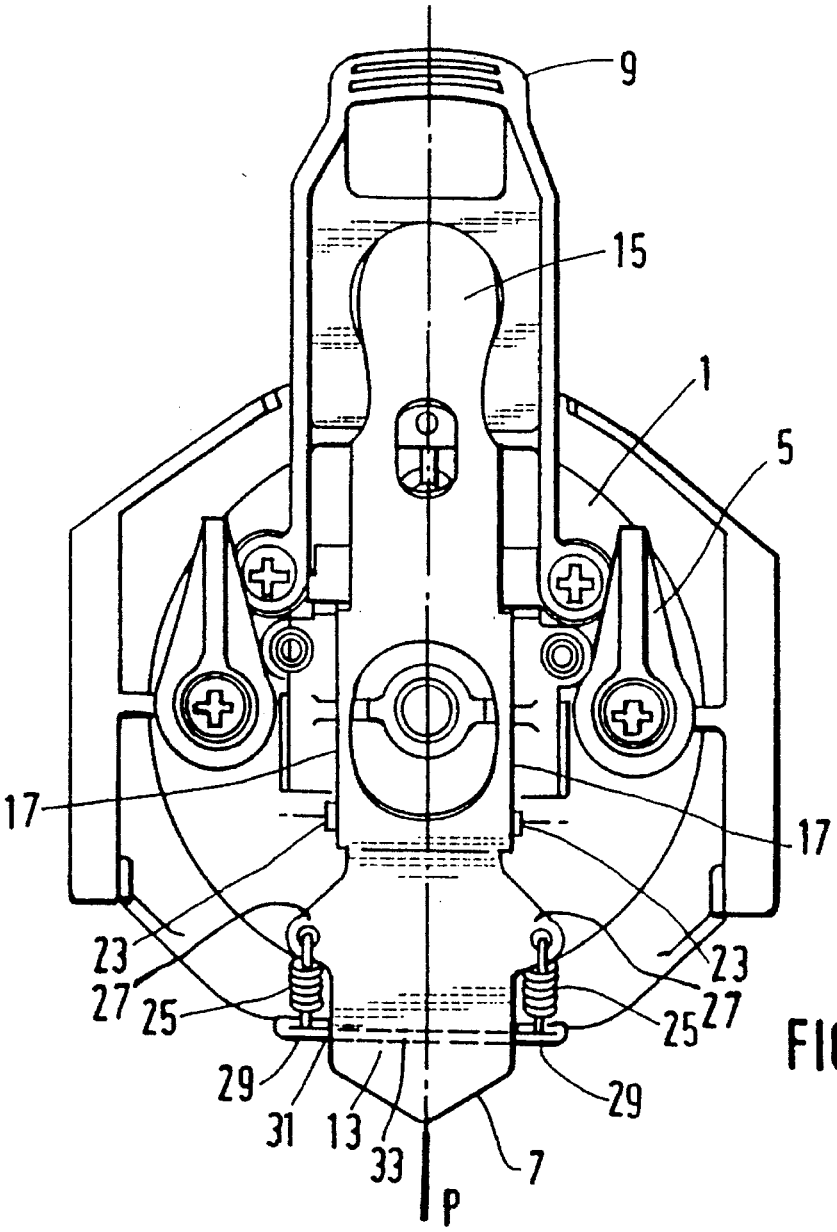
Figure 3:
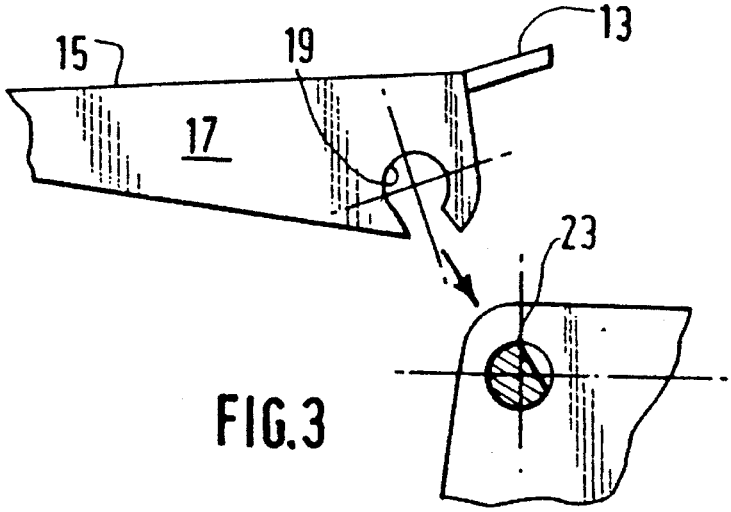
Figure 4:
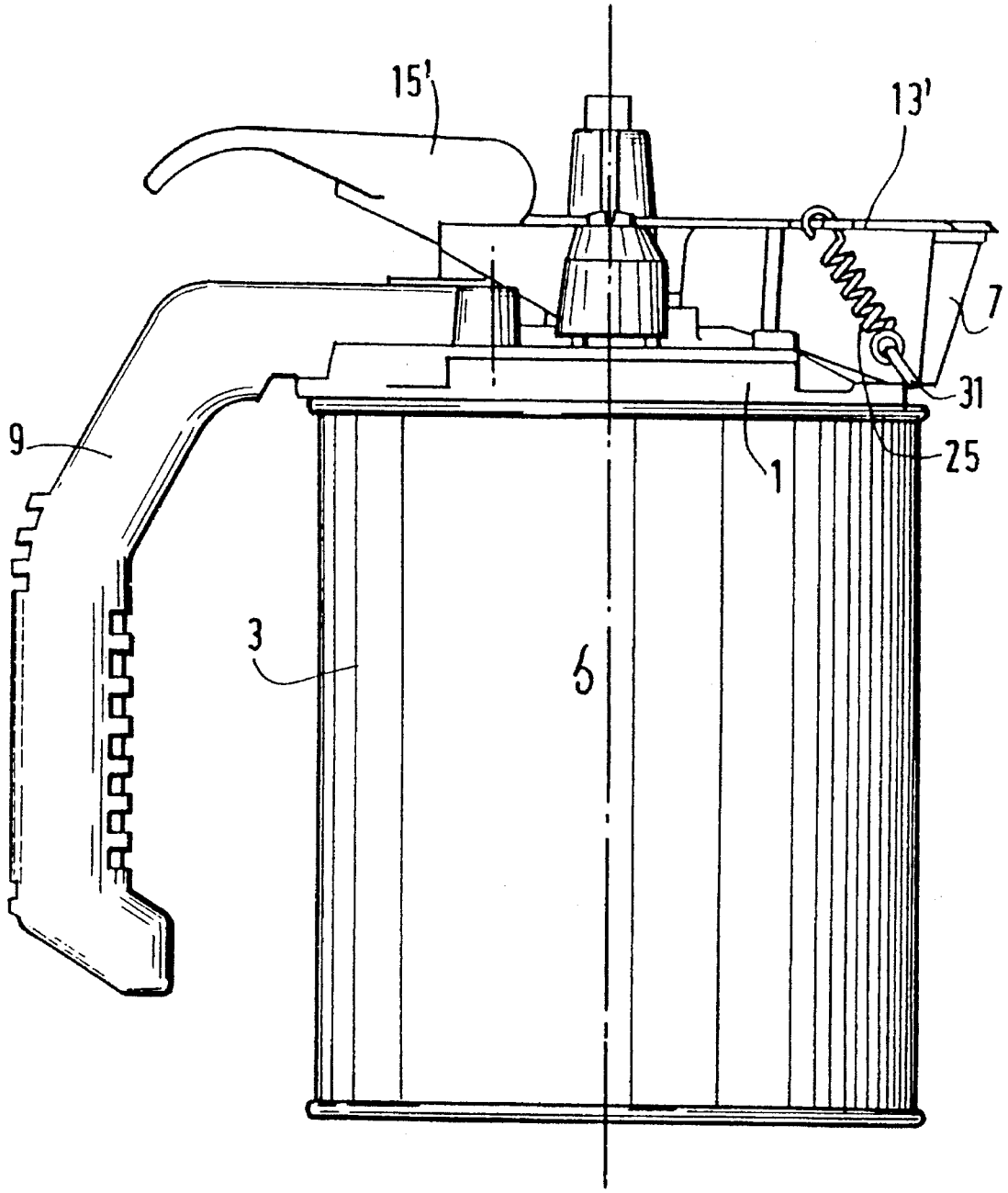
Figure 5:
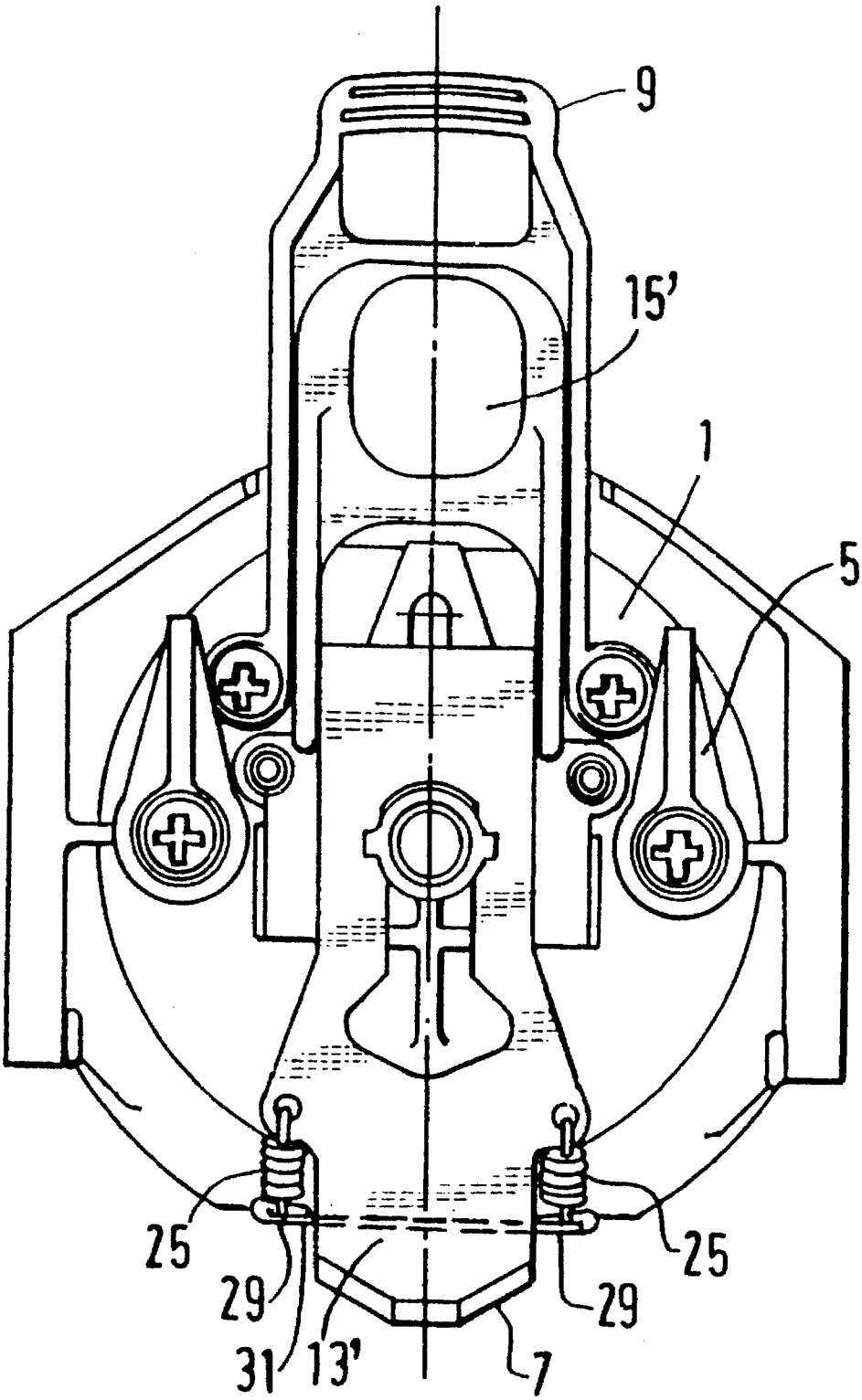

The invention is illustrated hereinbelow with the aid of embodiments and with reference to the appended drawings in which:

FIG. 1 is an elevation view of a lid according to the invention, mounted on a color can, FIG. 2 is a plan view of this lid, FIG. 3 is a view showing the mounting of the shutter on its pin, and FIGS. 4 and 5 are views of an alternative embodiment of a lid according to the invention, respectively in elevation and in plan.

Referring to FIGS. 1 and 2, the lid according to the invention is of the type having a circular body 1 mounted on an underlying color can. It is fixed to its upper opening by conventional cam elements 5 rotationally operated by jamming of their lower fastener against the lower edge of the can. In its lower part, it includes a stirring blade, not shown, rotationally driven inside the can by the corresponding drive system of the stirring machine on which it is designed to be mounted. On its front part, it comprises a pouring lip 7 projecting at the periphery of its body and a conventional gripping handle 9 at its rear part, opposite the pouring lip relative to the axis δ of the lid. The lip 7 is provided with an upper opening 11 which is formed in a horizontal plane and is closed in a sealed fashion in the not-in-use position by an angularly movable shutter 13. This shutter having the shape of a plate cut substantially to the size of the opening edge of the lip is firmly attached to an operating lever 15 on the opposite side from the lip and in line with the operating handle 9. This lever, coming from the same plate, suitably folded and cut, includes two parallel side flanges 17 by means of which it is pivotably mounted, by means of suitable pin holes 19, on a pin 21 firmly attached to the body of the lid. This pin consists of two side pin elements 23 projecting from the rear profiled part of the pouring lip and molded together with the body of the lid (made of aluminum alloy or of synthetic resin). The shutter is held in the closed position by means of two identical side helical springs 25 arranged parallel to the front part of the pouring lip. These springs are connected by their upper end to plane side fixing lugs 27 cut from the plate of the shutter and by their lower end to the two bent-over end parts, in the form of a lug 29, of a rod 31 held by the urging of the springs under the lower part of the lip in the angle of the lip and the body of the lid. This rod is engaged, with axial rotational freedom, in a complementary horizontal longitudinal groove 33 suitably closed at the lower part of the lip. The assembly comprising the elements of the shutter and the integral lever possesses a vertical mid-plane of symmetry P. The springs lie in two vertical planes (at equal distance from the plane P) and are oriented downward in the direction of the front part of the lip, substantially at an angle of 45° relative to the horizontal. Thus, they apply a force on the shutter directly according to the conforming geometry of the lip for optimum closure of the shutter. Simultaneously, they return the operating lever upward. Furthermore, the lower rod 31 for retaining the springs orients freely according to the urging of the return force, its lugs 29 rotating toward the force, especially on opening the shutter. Moreover, it should be noted that the mounting of the shutter and integral lever is facilitated by cutting, in an inclined plane (FIG. 3), the supporting elements of the pin 23 and by opening in a complementary fashion the pin holes of the flanges of the lever so that it can be mounted by insertion, in the direction of the arrow, and subsequently locked in the closed position. The return action of the springs also contributes to keeping the lever on its pin.

The functioning of the lid is very simple and is derived, of course, from the description of the elements of the aforementioned lid. It is sufficient to manually press downward on the end of the lever in order to open the shutter, the closure plate of the shutter opening upward in the direction of the arrow with an angular movement about its pin. Closure is achieved automatically by releasing the lever, returned upward under the urging of the spring.

The aforementioned kinematics of the return of the closure element into the closed position by side springs oriented forward can also function, as shown in FIGS. 4 and 5, with an element having a pull flap 13' for closing the opening in the lip. This pull flap can move translationally rearward by pressing the operating lever 15' downward, the lever this time being pivoted by its base in a corresponding hollowed shape in the body of the lid (known layout) and it comes forward again into the closed position on releasing the lever under the urging of the springs. The fixing of the springs to the pull flap and to the base of the pouring lip is identical to that in the previous embodiment.

We claim:

1. A stirrer lid for a color can which is positionable on paint stirring machines, said stirrer lid comprising a raised pouring lip; a sealing element for said pouring lip including shutter means (13, 13') for selectively opening and closing the pouring lip (7); an operating lever (15, 15') mounted on said lid for placing said sealing element into an open position for pouring the contents of the can; a pair of helical springs (25) for biasing said sealing element of the pouring lip into a closed position, said springs being two identical helical springs (25) for returning the sealing element (13, 13') into the closed position, said springs being arranged symmetrically relative to a vertical mid-plane (P) of the stirrer lid, each said spring having an upper end connected to the sealing element (13, 13') and a bottom end connected to a front base of the pouring lip (7) laterally relative to the pouring lip and being oriented downwardly toward the outer edge of the stirrer lid, each spring being connected at the ends thereof to a fastening element (27) on the sealing element and to a lower part of the pouring lip, said springs (25) being each connected at their lower ends to a rod (31) which is engaged and retained in a groove (33) in the front base of the pouring lip (7).

2. The stirrer lid according to claim 1, wherein said springs (25) are arranged in parallel, each lying in a vertical plane at an equal distance from said vertical mid-plane (P) of the pouring lid.

3. The stirrer lid according to claim 1, wherein said sealing element (13, 13') of the pouring lip is attached to the operating lever so as to be biased into the closed position simultaneously with the operating lever (15, 15') by said springs (25).

4. The stirrer lid according to claim 3, wherein the operating lever (15) is integrally formed with the sealing element (13).

5. The stirrer lid according to claim 4, wherein the operating lever (15) and the sealing element (13) are conjointly mounted for pivoting movement on the stirrer lid.

6. The stirrer lid according to claim 5, wherein the operating lever (15) and the sealing element (13) are conjointly pivoted on a pin (21) comprising two pin elements (23) which are located on opposite sides symmetrically relative to the mid-plane P, and are molded with the stirrer lid (1).

7. The stirrer lid according to claim 6, wherein two laterally spaced flanges (17) are connected with the operating lever (15) forming a supporting element for pivoting the operating lever on said pin (21) of the lid, these flanges each including a truncated opening (19) for closely fitted insertion therethrough of said pin and facilitating said pin to be mounted in an inclined position and locked in the closed position of said sealing element.

8. The stirrer lid according to claim 1, wherein said sealing element comprises a pull tab (13') operatively connected to said operating lever (15').

* * * * *